US012435874B2

(12) United States Patent
Lee et al.

(10) Patent No.: US 12,435,874 B2
(45) Date of Patent: Oct. 7, 2025

(54) DUAL VENTURI

(71) Applicant: KYUNGDONG NAVIEN CO., LTD., Gyeonggi-do (KR)

(72) Inventors: Kyu Hong Lee, Seoul (KR); Choong Gon Lee, Seoul (KR); Jun Kyu Park, Seoul (KR)

(73) Assignee: KYUNGDONG NAVIEN CO., LTD., Gyeonggi-do (KR)

( * ) Notice: Subject to any disclaimer, the term of this patent is extended or adjusted under 35 U.S.C. 154(b) by 51 days.

(21) Appl. No.: 18/525,913

(22) Filed: Dec. 1, 2023

(65) Prior Publication Data

US 2024/0183534 A1 Jun. 6, 2024

(30) Foreign Application Priority Data

Dec. 5, 2022 (KR) ..... 10-2022-0168035

(51) Int. Cl.

| | |
|---|---|
| ***F23N 1/02*** | (2006.01) |
| ***F23D 14/04*** | (2006.01) |
| ***F23D 14/60*** | (2006.01) |
| ***F23D 14/62*** | (2006.01) |

(52) U.S. Cl.

CPC ..... *F23N 1/027* (2013.01); *F23D 14/04* (2013.01); *F23D 14/60* (2013.01); *F23D 14/62* (2013.01); *F23N 2235/24* (2020.01); *F23N 2237/10* (2020.01)

(58) Field of Classification Search

CPC .. F23N 1/027; F23N 2235/24; F23N 2237/10; F23D 14/62; F23D 14/60; F23D 14/04

See application file for complete search history.

(56) References Cited

U.S. PATENT DOCUMENTS

| | | | | |
|---|---|---|---|---|
| 9,644,839 | B2 * | 5/2017 | Yu | F24H 9/2035 |
| 9,709,264 | B2 * | 7/2017 | Yu | F24H 9/2035 |
| 9,777,919 | B2 * | 10/2017 | Kim | F23C 9/08 |
| 10,215,404 | B2 * | 2/2019 | Lee | F23L 13/02 |
| 10,393,370 | B2 * | 8/2019 | Yu | F23D 14/46 |
| 2015/0000614 | A1 * | 1/2015 | Park | F24H 1/186 122/14.21 |
| 2015/0056563 | A1 | 2/2015 | Kim | |
| 2016/0061445 | A1 | 3/2016 | Kim et al. | |

OTHER PUBLICATIONS

Combined Search and Examination Report dated Apr. 17, 2024; United Kingdom Patent Application No. GB2317874.2; 5 pages.

* cited by examiner

*Primary Examiner* — John Bastianelli
(74) *Attorney, Agent, or Firm* — McDonald Hopkins LLC

(57) ABSTRACT

Provided is a dual venturi. The dual venturi includes a housing including a housing body opened in a reference direction so that a gas or air flows, an inner partition wall through which an inner space of the housing body is divided into a first conduit and a second conduit, and a gas providing part provided with a first gas conduit passing through the first conduit to allow the first conduit to communicate with the outside therein and a second gas conduit configured to allow the second conduit to communicate with the outside, an opening/closing unit disposed in the inner space to open and close the first gas conduit and the second conduit, and a driver connected to the opening/closing unit to provide driving force to the opening/closing unit.

12 Claims, 7 Drawing Sheets

DUAL VENTURI

CROSS-REFERENCE TO RELATED APPLICATIONS

This application claims the priority of Korean Patent Application No. KR10-2022-0168035 filed on Dec. 5, 2022, in the Korean Intellectual Property Office, the disclosure of which is incorporated herein by reference.

BACKGROUND OF THE INVENTION

Field of the Invention

The present invention relates to a dual venturi.

Description of the Related Art

In general, combustion devices such as boilers and water heaters used for heating and used for hot water are classified into oil boilers, gas boilers, electric boilers, and water heaters according to the supplied fuel and are developed and used in various manners to suit an installation purpose.

The performance of the combustion devices may be evaluated by a turn-down ratio (TDR). The turn-down ratio means 'a ratio of maximum gas consumption to minimum gas consumption' in a gas combustion device in which an amount of gas is variably controlled. The turn-down ratio (TDR) is limited according by how stable the flame is maintained under the minimum gas consumption conditions.

The larger a turn-down ratio (TDR) value, the greater convenience of gas boilers and water heaters that provide the heating and the hot water. When a combustion device operates in a region in which the turn-down ratio (TDR) value is small, and a load of the heating and hot water is small, the combustion device may be turned on/off frequently. The frequent turning on/off of the combustion device may increase in deviation of a temperature control and reduce durability of the device.

Thus, in order to improve this limitation, various methods have been developed to improve the turn-down ratio (TDR) of the combustion device applied to the combustion device. For example, a method is being used to improve combustion stability even at a low output by dividing an air and gas supply path into two or more regions and opening and closing each gas/air passage in response to an output of the combustion device to improve the turn-down ratio.

A dual venturi including two or more air and gas supply paths may open and close the air and gas supply paths using a damper and/or a blade. However, the dual venturis that use the damper may have a limitation such as sticking of the damper inside a gas passage. In addition, if the gas supply path provided inside the dual venturi is complicated, gas supply to the combustion device may be delayed.

SUMMARY OF THE INVENTION

An aspect of the present invention provides a dual venturi structure of a combustion device, in which sticking of a damper disposed inside the combustion device to control a flow of gas and delay of supplying of the gas due to a gas passage having a relatively long length are prevented.

According to an aspect of the present invention, there is provided a dual venturi including: a housing including a housing body opened in a reference direction so that a gas or air flows, an inner partition wall through which an inner space of the housing body is divided into a first conduit and a second conduit, and a gas providing part provided with a first gas conduit passing through the first conduit to allow the first conduit to communicate with the outside therein and a second gas conduit configured to allow the second conduit to communicate with the outside; an opening/closing unit disposed in the inner space to open and close the first gas conduit and the second conduit; and a driver connected to the opening/closing unit to provide driving force to the opening/closing unit, wherein the second gas conduit includes: a (second-1)th gas conduit configured to communicate with the outside and opened and closed by the opening/closing unit; and a (second-2)th gas conduit configured to allow the (second-1)th gas conduit to communicate with the second conduit.

The (second-1)th gas conduit may extend in a first direction crossing the reference direction, and the (second-2)th gas conduit may extend from one end of the (second-1)th gas conduit along a direction that is inclined to the reference direction with respect to the first direction to allow the (second-1)th gas conduit to communicate with the second conduit.

The first gas conduit may extend in the first direction, and the first gas conduit and the second gas conduit may be sequentially disposed along the reference direction.

The opening/closing unit may include a damper configured to control a flow of gas flowing through the second gas conduit, wherein the damper may move in a longitudinal direction of the (second-1)th gas conduit inside the (second-1)th gas conduit by the driver to control the flow of gas.

One end of the second gas conduit may include an opening that is exposed to the outside, the damper may move along the longitudinal direction toward the opening by the driver to open the (second-1)th gas conduit, and the damper may move in a direction opposite to the direction facing the opening to close the (second-1)th gas conduit.

The opening/closing unit may further include a spring disposed between the damper and the opening, when the damper may move toward the opening, the spring is compressed, and when the damper moves in a direction away from the opening, the compressed spring may be configured to allow the damper to be in close contact with an opening/closing hole defined in the (second-1)th gas conduit by restoring force.

The opening/closing unit may further include a cam assembly configured to connect the damper to the driver, wherein the cam assembly may include: a cam body disposed inside the second gas conduit and the second conduit; and a cam guide passing through the cam body to connect the damper to the driver.

The opening/closing unit may further include a blade assembly coupled to the cam body, wherein the blade assembly may rotate inside the second conduit to control a flow of air flowing in the second conduit.

The blade assembly may include: a blade body connected to the driver and disposed inside the second conduit; and a wing part disposed on an outer surface of the blade body to open and close the second conduit, the cam body may include: a first cam body disposed inside the second gas conduit; and a second cam body connected to the first cam body and being in contact with the blade assembly of the opening/closing unit, the second cam body may move in the direction facing the opening or an opposite direction by allowing the blade body to rotate by the driver so that convex portions of each of the second cam body and the blade body are in contact with each other to correspond to each other or are engaged with each other, and the cam guide connected to the second cam body may pass through the first cam body to allow the damper to move in the direction facing the opening or the opposite direction.

The (second-1)th gas conduit may include: a (second-1-1)th gas conduit having one end communicating with the outside and comprising the opening; and a (second-1-2)th gas conduit having a portion communicating with the other end of the (second-1-1)th gas conduit and the other portion communicating with the (second-2)th gas conduit, wherein the damper may be disposed inside the (second-1-1)th gas conduit to cover a portion of a contact surface of the first cam body disposed inside the (second-1-2)th gas conduit.

An opening/closing hole through which the inside of the (second-1-1)th gas conduit and the inside of the (second-1-2)th gas conduit are connected to each other may be defined in the portion of the contact surface, and the damper may be configured to cover the opening/closing hole so as to block a flow of gas flowing through the (second-1-2)th gas conduit in the (second-1-1)th gas conduit.

According to another aspect of the present invention, there is provided a dual venturi including: a housing including a housing body opened in a reference direction so that a gas or air flows, an inner partition wall through which an inner space of the housing body is divided into a first conduit and a second conduit, and a gas providing part provided with a first gas conduit passing through the first conduit to allow the first conduit to communicate with the outside therein and a second gas conduit configured to allow the second conduit to communicate with the outside; an opening/closing unit disposed in the inner space to open and close the first gas conduit and the second conduit; and a driver connected to the opening/closing unit the cam assembly to provide driving force to the opening/closing unit, wherein the second gas conduit is configured to communicate with one region of the second conduit adjacent to the cam assembly, and the opening/closing unit moves in a longitudinal direction of the (second-1)th gas conduit inside the (second-1)th gas conduit by the driver to control a flow of gas introduced from the outside to the (second-1)th gas conduit.

The opening/closing unit may include: a damper moving inside the (second-1)th gas conduit; and a blade assembly rotating inside the second conduit, wherein the blade assembly may be configured to control a flow of air flowing through the second conduit.

The opening/closing unit may further include a spring disposed between an opening of the (second-1)th gas conduit and the damper, wherein the spring may be configured to transmit restoring force to the damper so as to control the flow of gas into the (second-1)th gas conduit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
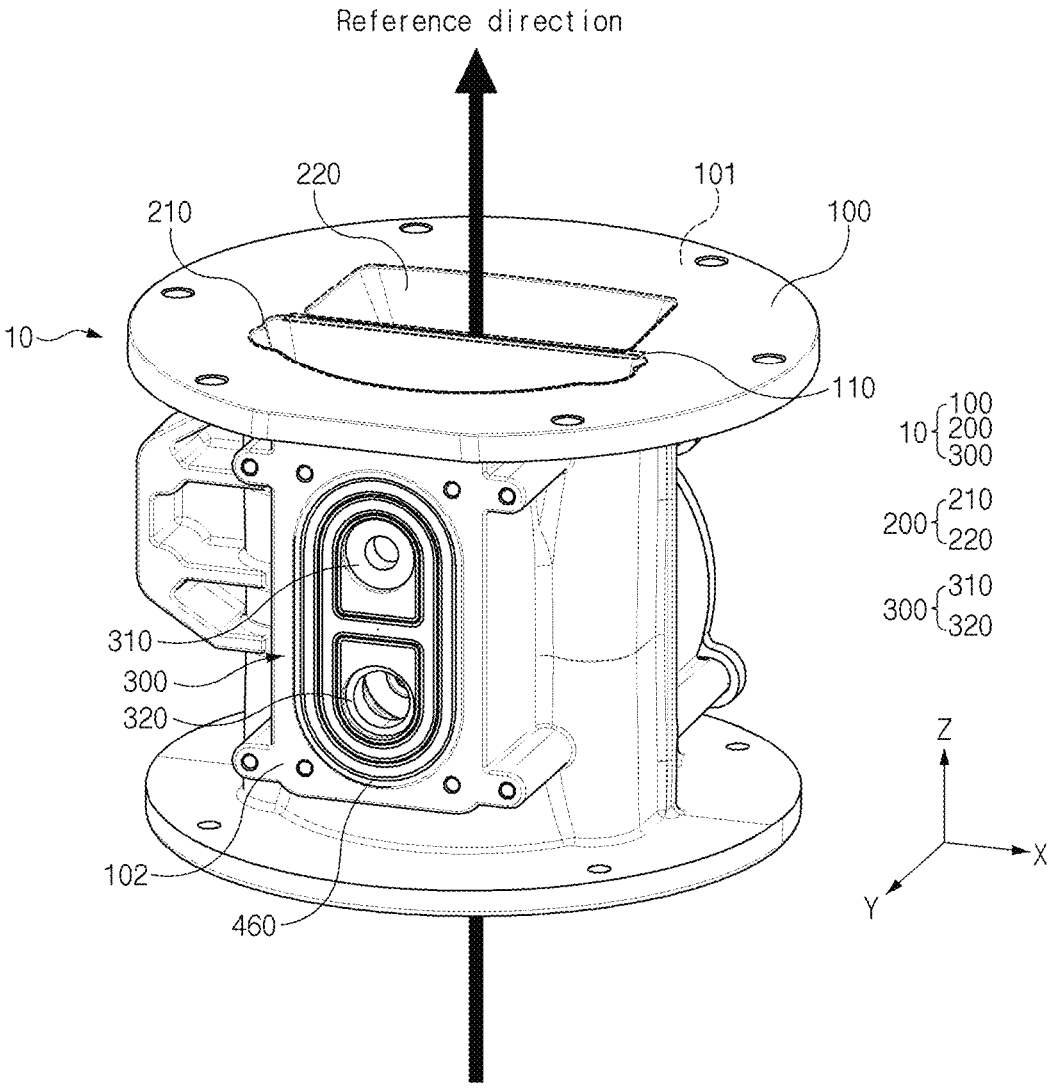
FIG. 1 is a perspective view of a dual venturi according to an embodiment of the present invention.

Hereinafter, embodiments of the present invention will be described in detail with reference to the accompanying drawings. In adding of reference numerals to components of each drawing, it should be noted that the same components have the same numerals as much as possible even if the components are displayed on different drawings. In the following description of the present invention, a detailed description of known functions and configurations incorporated herein will be omitted to avoid making the subject matter of the present invention unclear.

In this specification, a reference direction, a first direction, and a second direction are referred to for convenience of explanation and are determined relative to a direction in which a dual venturi is arranged, and also, an opposite direction does not necessarily mean a symmetrical direction.

In addition, the term conduit or passage used below may mean a tube-shaped conduit, through which a fluid flows, and may refer to components that have various materials and shapes, such as a soft tube and a metal pipe.

A dual venturi according to an embodiment of the present invention may include a venturi including a plurality of conduits through which a gas or air flows. The dual venturi may be a dual venturi used in a boiler or combustion appliance.

First, fundamental components of the dual venturi according to an embodiment of the present invention will be described in detail with reference to the drawings.

Figure 2:
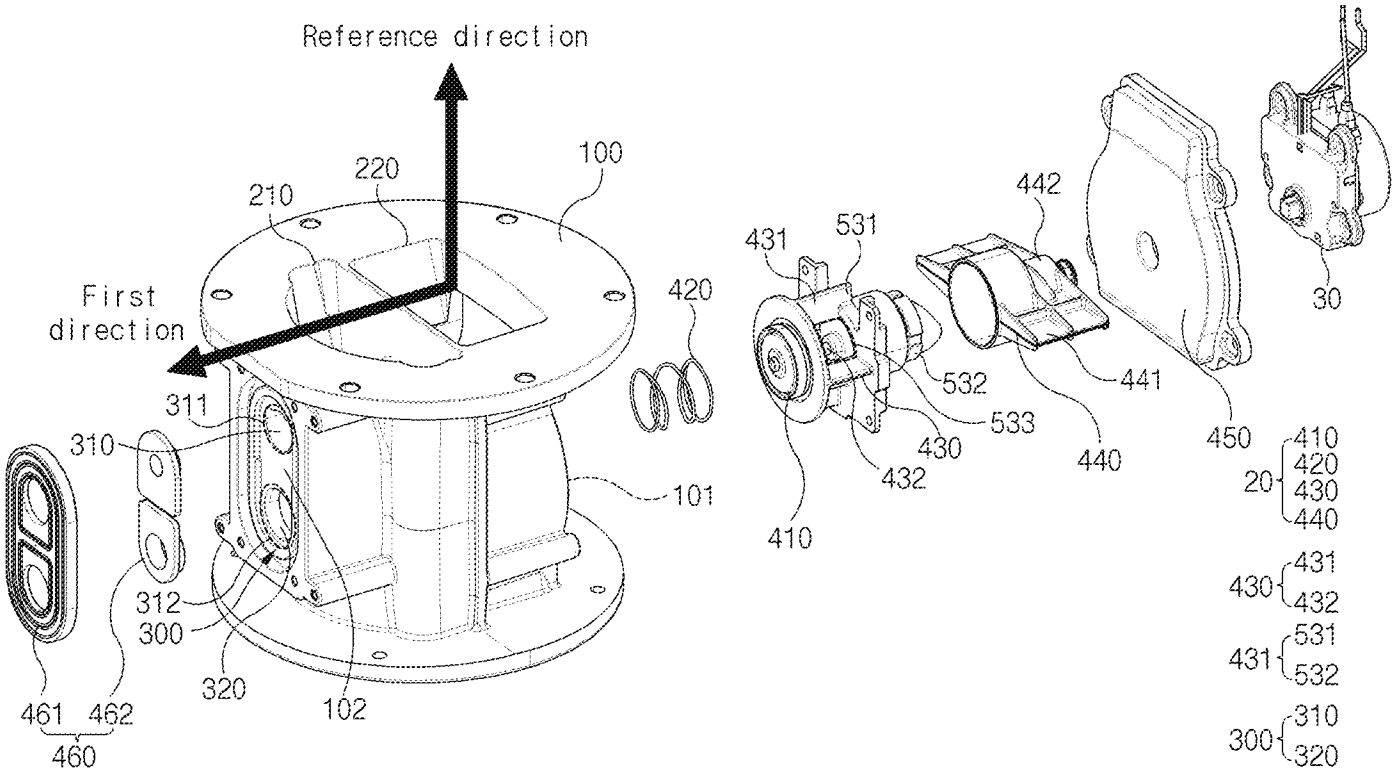
FIG. 2 is an exploded view of FIG. 1.

FIG. 1 is a perspective view of a dual venturi according to an embodiment of the present invention. FIG. 2 is an exploded view of FIG. 1.

Figure 3:
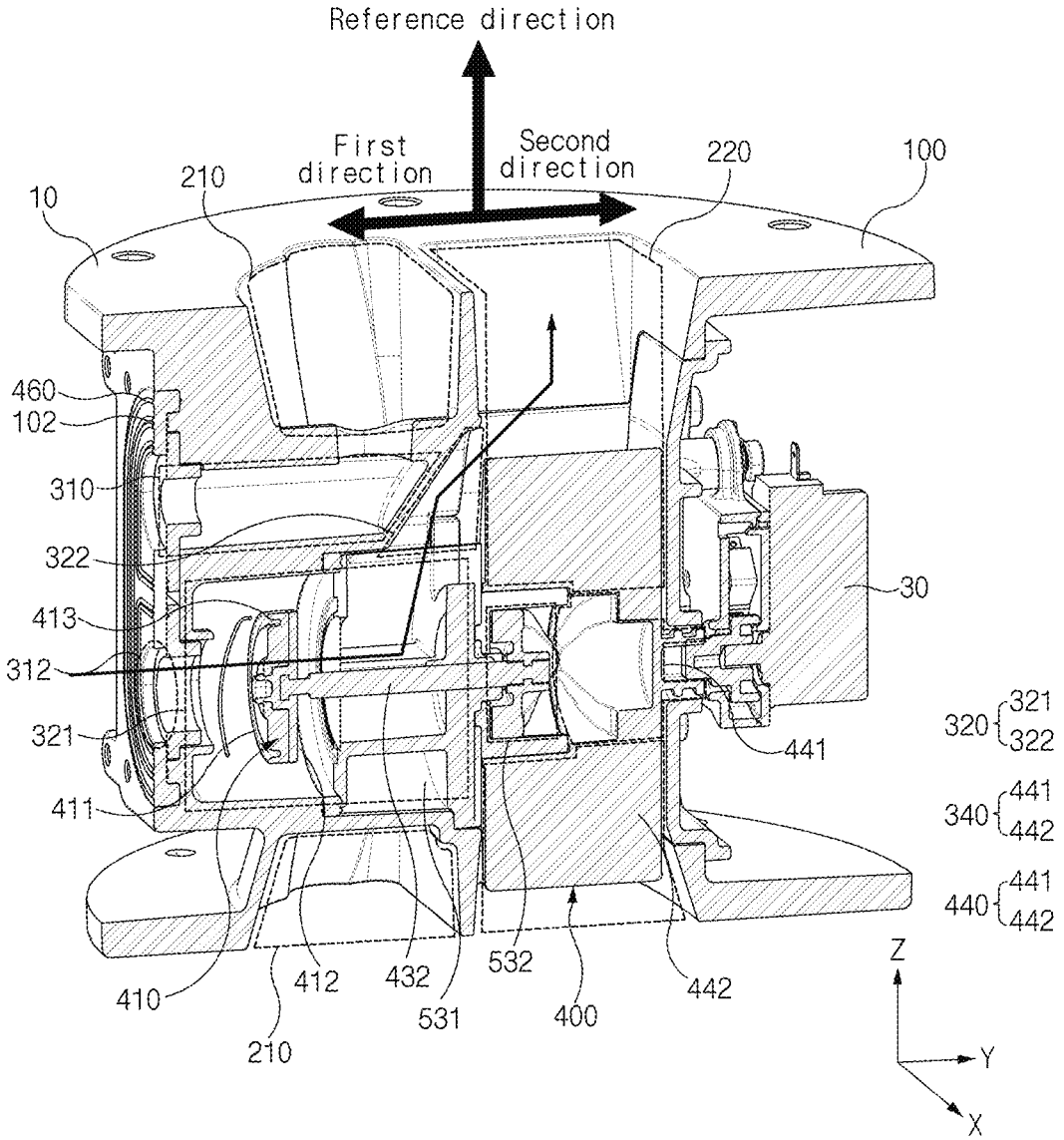
FIG. 3 is a view illustrating the inside of the dual venturi.

FIG. 3 is a view illustrating the inside of the dual venturi.

Figure 4:
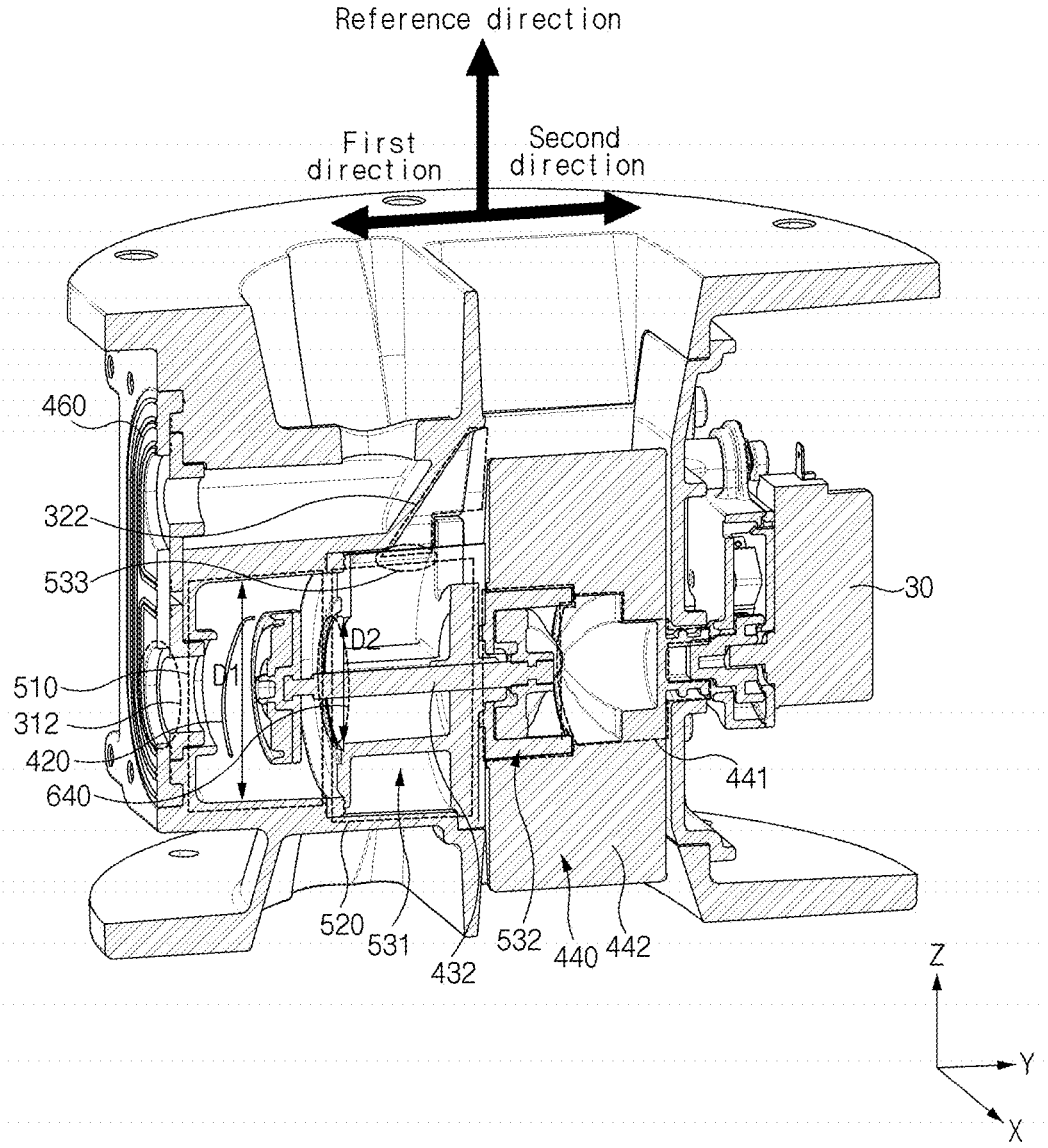
FIG. 4 is a view illustrating a (second-1-1)th gas conduit and a (second-1-2)th gas conduit in the dual venturi of FIG. 3.

FIG. 4 is a view illustrating a (second-1-1)th gas conduit and a (second-1-2)th gas conduit in the dual venturi of FIG. 3.

Figure 5:
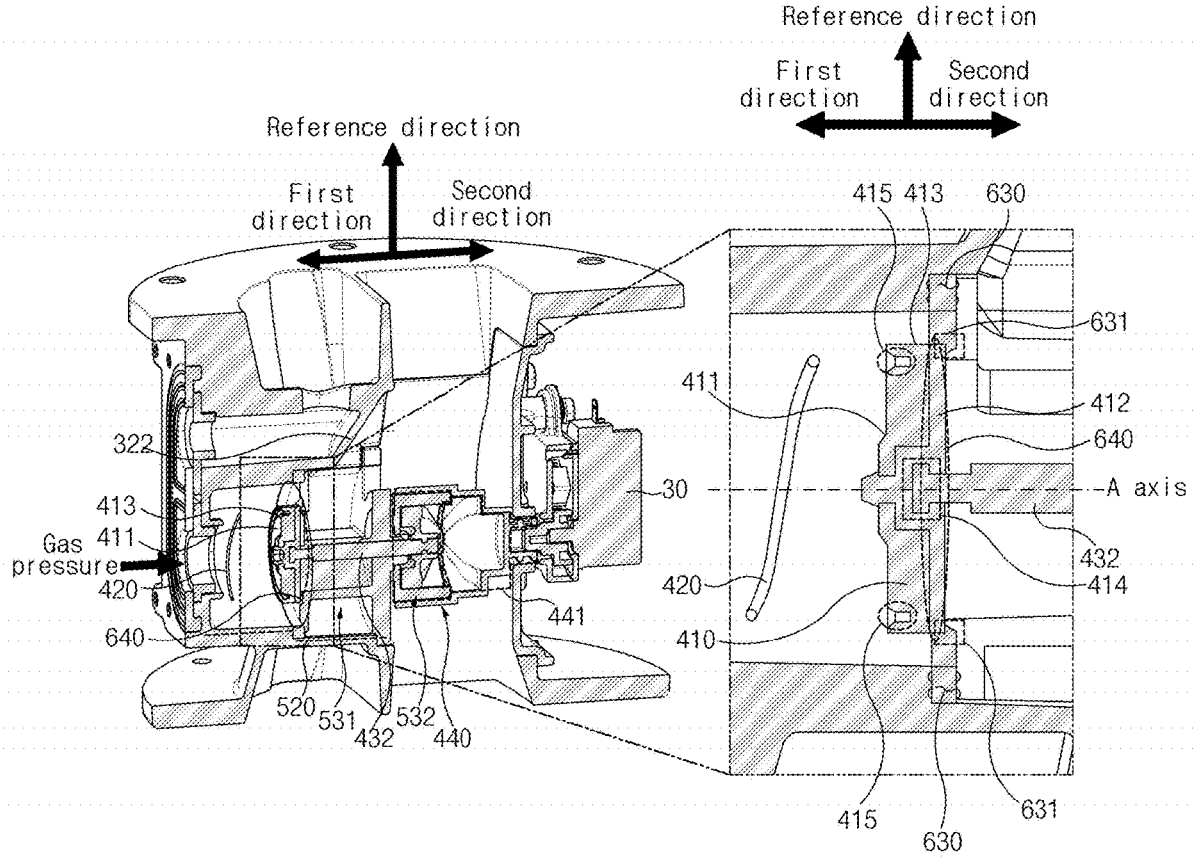
FIG. 5 is a detailed view illustrating a damper and components adjacent to the damper together with a configuration inside the dual venturi of FIG. 3.

FIG. 5 is a detailed view illustrating a damper and components adjacent to the damper together with a configuration inside the dual venturi of FIG. 3.

A dual venturi according to an embodiment of the present invention may include a housing 10, an opening/closing unit 20, and a driver 30. The housing 10 may include a housing body 100, a plurality of conduits 200, and a gas providing part 300.

A gas or air introduced from the outside to the inside may pass through the gas providing part 300 or the plurality of conduits 200 and then be discharged.

The housing body 100 may provide a passage for the gas or air introduced into the dual venturi. For example, an empty space may be defined in a portion of the housing body 100, and the plurality of conduits 200 may be provided by the empty space. The gas or air may flow inside the dual venturi through the plurality of conduits 200.

The plurality of conduits 200 may be disposed toward a reference direction. The reference direction is a direction in which the air flows into the housing body 100. For example, referring to FIG. 1, the reference direction may be a positive z-direction of FIG. 1, but this is only an example and is not limited to the positive z-direction.

A first or second direction described later is a direction crossing the reference direction. For example, the first direction may be a direction perpendicular to the reference direction, but is not limited thereto. For example, the first direction may be a direction forming an acute angle within about 1 degree to about 90 degrees from the reference direction.

According to an embodiment of the present invention, the plurality of conduits 200 disposed along the reference direction may include a first conduit 210 and a second conduit 220.

Air may flow inside the first conduit 210 and the second conduit 220. A gas introduced from the gas providing part 300 may flow in a partial space of the first conduit 210. The gas introduced from the gas providing part 300 may selectively flow in a partial space of the second conduit 220.

The first conduit 210 and the second conduit 220 may be distinguished by a portion of the housing 10. For example, the first conduit 210 and the second conduit 220 may be partitioned by an inner partition wall 110 of the housing 10.

The inner partition wall 110 may be integrated with the housing body 100, but is not limited thereto. For example, the inner partition wall 110 may be coupled to the housing body 100 as a separate component.

The gas may be introduced into the dual venturi through the gas providing part 300. For example, the gas providing part 300 may include a plurality of gas conduits, and the gas introduced from the outside may be introduced into the housing body 100 through the gas providing part 300.

The gas providing part 300 may include a first gas conduit 310 and a second gas conduit 320. The first gas conduit 310 may be connected to the first conduit 210. The second gas conduit 320 may be connected to the second conduit 220.

A specific embodiment related to the first gas conduit 310 and the second gas conduit 320 will be described in detail later with reference to FIGS. 3 to 5.

Referring to FIG. 2, the gas providing part 300 may include a plurality of openings. For example, the first gas conduit 310 may include a first opening 311, and the second gas conduit 320 may include a second opening 312. Each of the first opening 311 and the second opening 312 may include an inlet through which the gas is introduced into the dual venturi through the gas providing part 300.

The first opening 311 and the second opening 312 may be provided in a side surface of the housing body 100. For example, the first opening 311 and the second opening 312 may be defined in a second side surface 102 opposite to a first side surface 101 of the housing body 100 to which the driver 30 is coupled.

A nozzle assembly 460 may be disposed in the first opening 311 and the second opening 312. For example, the nozzle assembly 460 may be coupled to the first opening 311 and the second opening 312.

The nozzle assembly 460 may include a packing 461 and a nozzle 462.

The packing 461 may be disposed on the second side surface 102 of the housing body 100. For example, the packing 461 may be disposed on the first opening 311 and the second opening 312 defined in the second side surface 102 and may be exposed to the outside.

The packing 461 may seal the gas introduced into the dual venturi. For example, the packing 461 may prevent the gas supplied to the first opening 311 and the second opening 312 from leaking to the outside.

The nozzle 462 may be disposed between the packing 461 and the first and second openings 311 and 312. For example, the nozzle 462 may not be exposed to the outside. For another example, a portion of the nozzle 462 may be exposed to the outside, but is not limited thereto.

The nozzle 462 may adjust a supply amount of gas introduced into the dual venturi. For example, the nozzle 462 may adjust the supply amount of gas introduced through the first opening 311 and the second opening 312 according to a shape of the hole of the nozzle 462.

The nozzle 462 may be replaced depending on the type of gas. For example, the nozzle for supplying an LPG gas and the nozzle for supplying an LNG gas may be used as different nozzles, but are not limited thereto. For example, even when different gases are supplied, substantially the same nozzle may be used.

The dual venturi includes an opening/closing unit 20 disposed in an inner space of the housing 10.

The dual venturi may include the opening/closing unit 20 to control a flow or the gas or air flowing in the inner space of the housing 10. For example, the gas or air may selectively flow within the second gas conduit 320 and the second conduit 220 by the opening/closing unit 20. For example, the opening/closing unit 20 may move within the second gas conduit 320 and rotate within the second conduit 220 to selectively block or open the flow of gas or air.

The opening/closing unit 20 may include a damper 410.

The flow of gas flowing in the inner space of the housing 10 may be controlled by the damper 410. For example, the flow of gas flowing in the second gas conduit 320 may be controlled by the damper 410. For example, a portion of a space of a (second-1)th gas conduit 321 of the second gas conduit 320 may be blocked by the damper 410 to block the flow of gas flowing inside the second gas conduit 320.

Referring to FIGS. 3 and 5, the damper 410 may include a front surface 411, a rear surface 412, and a side surface 413.

The front surface 411 may be an outer surface of the damper 410 facing the second opening 312.

The rear surface 412 may be an outer surface of the damper 410 facing a direction in which the driver 30 or the cam assembly 430 is disposed. For example, the rear surface 412 may face a direction opposite to the direction towards the second opening 312.

The side surface 413 may be an outer surface of the damper 410 extending between the front surface 411 and the rear surface 412.

The damper 410 may be made by combining two or more different materials. For example, a first material defining the front surface 411 of the damper 410 may be made of plastic, and a second material defining the rear surface 412 may be made of rubber.

However, the fact that the first material is made of plastic, and the second material is made of rubber is only an example and is not limited thereto. For example, the first material may be made of rubber different from that of the second material.

The front surface 411 of the damper 410 may be in contact with a spring 420. Referring to FIG. 5, a groove 415 may be defined in the front surface 411 of the damper 410. For example, the groove 415 defined in the front surface 411 may be provided as an annular groove 415, and the spring 420 may be inserted into the annular groove 415. The spring 420 may be inserted into the annular groove 415, and thus, the spring 420 and the damper 410 may be coupled to each other.

The shape of the above-described groove has been explained as the annular groove, but it is not limited thereto.

Since the spring 420 is coupled to the damper 410 through the annular groove 415, the spring 420 may be disposed inside the second gas conduit 320 more stably than the spring that is not coupled to the damper. For example, the spring 420 may be stably disposed inside the second gas conduit 320 to prevent a gas leakage limitation due to the spring 420 that is caught inside the second gas conduit 320.

Referring to FIG. 5, a cross section of the groove 415 may be provided in a tapered shape toward the second direction.

Referring to FIG. 5, the rear surface 412 of the damper 410 may be connected to a cam assembly 430. The rear surface 412 of the damper 410 may include an insertion groove 414 that is inserted into the inner space of the damper 410.

A cam guide 432 of the cam assembly 430 may be inserted into the insertion groove 414. The cam guide 432 may be inserted to connect the cam guide 432 to the damper 410. In an example, the cam guide 432 may be coupled to the damper 410 by allowing a protrusion of the cam guide 432 to be hooked with a protrusion of the insertion groove 414. For example, the insertion groove 414 may be provided in a T shape, and the cam guide 432 provided in a T shape may be inserted into the insertion groove 414, and thus, the damper 410 and the cam assembly 430 may be coupled to each other.

As the damper 410 is connected to the cam guide 432, the damper 410 may perform linear movement within the second gas conduit 320 by the driver 30. For example, the damper 410 may linearly move along a longitudinal direction of the second gas conduit 320 in the direction from the inside of the (second-1)th gas conduit 321 of the second gas conduit 320 to the second opening 312 or in the opposite direction.

For example, as the driver 30 rotates, the cam assembly 430 may allow the damper 410 to move in the direction toward the second opening 312. For example, the cam assembly 430 may push the damper 410 in the direction toward the second opening 312.

An embodiment related to the movement of the cam assembly 430 and the damper 410 will be described in detail later with reference to an embodiment related to the cam assembly 430.

As the damper 410 moves in the direction toward the second opening 312 by the driver 30, the second gas conduit 320 may be opened.

As the second gas conduit 320 is opened by the driver 30, delay of the supply of the gas supply to the second conduit 220 through the second gas conduit 320 may be prevented rather than a case in which the gas conduit is opened by restoring force of a member having elasticity such as the spring. The opening of the gas conduit by the driver 30 may be opened more quickly than the opening of the gas conduit by the spring. For example, even when the damper 410 is sticked within the second gas conduit 320, the damper 410 may move within the second gas conduit 320 by driving force of the driver 30, and thus, the second gas conduit 320 may be opened. The second gas conduit 320 may be quickly opened to prevent the gas supply from being delayed.

The opening/closing unit 20 may further include a spring 420 disposed in the inner space of the housing 10. For example, the spring 420 may be disposed inside the second gas conduit 320 provided in the inner space of the housing 10. For example, the spring 420 may be disposed between the second opening 312 of the second gas conduit 320 and the damper 410 inside the (second-1)th gas conduit 321 of the second gas conduit 320.

An annular opening groove coupled to the spring 420 may be defined in the second opening 312 of the (second-1)th gas conduit 321.

One end of the spring 420 may be coupled to the opening groove of the second opening 312 and connected to the second opening 312. The other end of the spring 420 may be connected to the damper 410 by being inserted into the annular groove defined in the damper 410, as described above.

As a portion of the spring 420 may be coupled to the damper 410, and the other portion of the spring 420 may be coupled to the second opening 312, the spring 420 may be more stably disposed inside the second gas conduit 320 than the spring that is not coupled to the damper. For example, the spring 420 may be stably disposed inside the second gas conduit 320 to prevent a gas leakage limitation due to the spring 420 that is caught inside the second gas conduit 320.

As the spring 420 provides the restoring force to the damper 410, the flow of gas blocked by the damper 410 coupled to the spring 420 may be blocked more effectively than the case in which the damper 420 is not in contact with the spring 420.

As the damper 410 airtightly closes the (second-1)th gas conduit 321 using the spring 420 and a gas pressure, the gas leakage from the (second-1)th gas conduit 321 may be prevented.

The gas may be prevented from leaking, and thus, an additional injection member for gas management may not be required. Since the additional injection member is not required, the types of components constituting the dual venturi may be simplified, and management of the dual venturi may be easy.

An embodiment related to the spring 420 will be described in detail later with reference to FIGS. 3 to 5.

According to an embodiment of the present invention, the opening/closing unit 20 may further include a cam assembly 430 connecting the damper 410 to the driver 30.

The cam assembly 430 may include a cam body 431 corresponding to a main body and a cam guide 432 passing through the cam body 431.

The cam body 431 may be disposed inside the (second-1)th gas conduit 321 and the second conduit 220. The cam guide 432 may pass through the cam body 431 and may be disposed over the (second-1)th gas conduit 321 and the second conduit 220.

Referring to FIG. 3, the cam body 431 may include a first cam body 531 and a second cam body 532.

The first cam body 531 may be disposed inside the second gas conduit 320. For example, the first cam body 531 may be disposed inside the (second-1)th gas conduit 321 of the second gas conduit 320. For example, the first cam body 531 may be disposed inside the (second-1-2)th gas conduit 520 of the (second-1)th gas conduit 321. For example, the first cam body 531 may be inserted into the (second-1-2)th gas conduit 520.

The first cam body 531 may include an area of which a portion is cutoff. For example, referring to FIGS. 3 and 5, a portion of the first cam body 531 may be cut off, and thus, a third opening 533 may be defined in the portion of the first cam body 531. The third opening 533 may be defined between the (second-1-2)th gas conduit 520 and the (second-2)th gas conduit 322. The third opening 533 may include an inlet of the (second-2)th gas conduit 322. For example, the gas introduced into the (second-1)th gas conduit 321 through the third opening 533 may flow into the (second-2)th gas conduit 322.

The first cam body 531 in which the third opening 533 is defined may provide a passage through which the gas introduced into the (second-1-2)th gas conduit 520 flows into the (second-2)th gas conduit 322.

The second cam body 532 may be disposed inside the second conduit 220. For example, the second cam body 532 may be coupled to a blade assembly 440 inside the second conduit 220.

The second cam body 532 may be a body connected to the cam guide 432 so that the damper 410 moves linearly in the first direction.

The cam guide 432 may pass through the first cam body 531 and the second cam body 532 and may connect the damper 410 to the driver 30.

For example, one end of the cam guide 432 may be coupled to the inside of the second cam body 532. The other end of the cam guide 432 may be coupled to the inside of the damper 410. As described above, the cam guide 432 may be inserted into the insertion groove 414 of the damper 410, and thus, the cam guide 432 may be coupled to the inside of the damper 410.

The cam guide 432 may pass through the inside of the first cam body 531. The cam guide 432 may pass through the first cam body 531 to connect the second cam body 532 to the damper 410.

The cam guide 432 may perform linear movement inside the first cam body 531.

For example, the cam guide 432 passing through the first cam body 531 may move linearly in the first direction or in the direction toward the second opening 312 inside the first cam body 531. The cam guide 432 passing through the first cam body 531 may move linearly inside the first cam body 531 toward a second direction or a direction opposite to the second opening 312.

The second cam body 532 may be disposed to be engaged with the blade body 441 of the blade assembly 440, which will be described later. For example, a convex portion of the second cam body 532 and a convex portion of the blade body 441 may be disposed to be in contact with each other and engaged with each other.

The convex portion of the second cam body 532 may include a first mountain and a first valley. The blade body 441 may include a second mountain and a second valley.

The first mountain of the convex portion of the second cam body 532 and the second valley of the convex portion of the blade body 441 may be arranged to be in contact with each other and engaged with each other. The first valley of the convex portion of the second cam body 532 and the second mountain of the convex portion of the blade body 441 may be disposed to be in contact with each other and engaged with each other.

The mountain and valley that are in contact with each other may be disposed to be engaged with each other, and thus, the convex portion of the second cam body 532 and the convex portion of the blade body 441 may be disposed to be in contact with each other and engaged with each other.

As the convex portion of the second cam body 532 and the convex portion of the blade body 441 are in contact with each other, the second cam body 532 may move in the direction opposite to the direction toward the second opening 312.

As the second cam body 532 moves in the direction opposite to the direction toward the second opening 312, the cam guide 432 connected to the second cam body 532 may move linearly in the second direction.

As the driver 30 rotates, the blade body 441 connected to the driver 30 may rotate. As the blade body 441 rotates, the first mountain of the convex portion of the second cam body 532 and the second mountain of the convex portion of the blade body 441 may be disposed to correspond to each other without being engaged with each other.

The mountains of the convex portions may be disposed to be in contact with so as to correspond to each other, and thus, the blade body 441 may push the second cam body 532 in the direction toward the second opening 312. The second cam body 532 may push the second cam guide 432 in the direction toward the second opening 312, and thus, the cam guide 432 connected to the second cam body 532 may move linearly in the first direction or the direction toward the second opening 312.

The cam guide 432 connected to the second cam body 532 may pass through the first cam body 531 to linearly moves inside the first cam body 531 in the first direction or in the direction toward the second opening 312.

As the arrangement relationship between the blade body 441 and the second cam body 532 is changed due to the rotation of the driver 30, the cam guide 432 may move linearly in the first or second direction. According to the linear movement of the cam guide 432, the damper 410 may move linearly in the first or second direction.

The cam guide 432 may transmit driving force transmitted through the driver 30 to the damper 410.

The opening/closing unit 20 may further include a blade assembly 440 that rotates in the inner space of the housing 10.

The blade assembly 440 may include a blade body 441 and a wing part 442.

The blade body 441 may be disposed inside the second conduit 220 to rotate about one axis. The one axis may include a virtual axis extending along the first direction. For example, the one axis may be a central axis of the blade body 441.

A partial area of the blade body 441 may be physically connected to the driver 30. For example, as the blade body 441 is physically connected to the driver 30, the blade body 441 may rotate around the axis by the driver 30.

The other partial area of the blade body 441 may be in contact with the second cam body 532. For example, the other partial area of the blade body 441 may be in contact with the second cam body 532 while being engaged with each other.

As described above, the blade body 441 may include a convex portion, and the second cam body 532 may include a convex portion.

The convex portion of the blade body 441 may be disposed to be in contact with the convex portion of the second cam body 532 without being engaged with the convex portion of the second cam body 532. For example, a second mountain of the convex portion of the blade body 441 and a first mountain of the convex portion of the second cam body 532 may be disposed to be in contact with each other so as to correspond to each other without being engaged with each other.

As the blade body 441 rotates by the driver 30, the second mountain of the convex portion of the blade body 441 and a first valley of the convex portion of the second cam body 532 may be disposed to be in contact with and engaged with each other.

As the mountains of the convex portions are in contact with each other to correspond to each other without being engaged, the second cam body 532 may move in a direction toward the second opening 312.

As the mountains and valleys of the convex portions are in contact with each other so as to be engaged with other, the second cam body 532 may move in a direction opposite to the direction toward the second opening 312.

The wing part 442 may be disposed on an outer surface of the blade body 441. For example, the wing part 442 may be disposed on the outer surface of the blade body 441 to be symmetrical about the axis. However, the symmetrically provided shape of the wing part 442 may be only an example, and is not limited thereto. For example, the wing part 442 may be disposed asymmetrically about one axis.

As the blade body 441 rotates inside the second conduit 220, the wing part 442 may also rotate inside the second conduit 220. As the wing part 442 rotates inside the second conduit 220, air may selectively flow inside the second conduit 220. For example, the wing part 442 may block the air flowing inside the second conduit 220 by closing the second conduit 220. For example, the wing part 442 may rotate in a range of about 1 degree to about 90 degrees to allow the air flowing inside the second conduit 220 to flow.

The driver 30 connected to the opening/closing unit 20 may provide the driving force to the opening/closing unit 20. The driver 30 may transmit the driving force to the blade assembly 440 and the damper 410 through the cam assembly 430 to control the flow of air or gas flowing inside the second gas conduit 320 and the second conduit 220.

As the damper 410 moves by the driver 30, the limitation of delaying the gas supply due to sticking of the damper 410 may be prevented. For example, as the second gas conduit 320 is opened by the driver 30, the delay in gas supply to the second conduit 220 may be prevented compared to the case in which the second gas conduit 320 is opened by the spring.

The opening of the gas conduit by the driver 30 may be opened more quickly than the opening of the gas conduit by the spring. For example, even when the damper 410 is sticked within the second gas conduit 320, the damper 410 may move within the second gas conduit 320 by the driving force of the driver 30. The second gas conduit 320 may be quickly opened to prevent the gas supply from being delayed.

The gas may be prevented from leaking, and thus, an additional injection member for gas management may not be required. Since the additional injection member is not required, the types of components constituting the dual venturi may be simplified, and management of the dual venturi may be easy.

The driver 30 may include a motor, but is not limited thereto.

The opening/closing unit 20 including the damper 410, the spring 420, the cam assembly 430, the blade assembly 440, and the cam plate 450 may be coupled to the inside of the housing 10.

For example, the opening/closing unit 20 may be coupled to the housing 10 toward the first direction crossing the reference direction. For example, the opening/closing unit 20 may be coupled to the housing 10 in the second direction in a state in which the spring 420, the damper 410, the cam assembly 430, the blade assembly 440, and the cam plate 450 are sequentially arranged in the first direction. However, the coupling sequence of the opening/closing unit 20 described above may be only an example, but is not limited thereto.

The cam plate 450 may be a plate that supports the cam assembly 430 and the blade assembly 440. For example, the blade assembly 440 may be coupled to one surface of the cam plate 450, and the driver 30 may be coupled to the other surface of the cam plate 450.

Referring to FIGS. 3 to 5, the gas providing part 300 may include a first gas conduit 310 and a second gas conduit 320.

The first gas conduit 310 may include a passage that transfers gas introduced from the outside to the first conduit 210. For example, the first gas conduit 310 may pass through the first conduit 210 to allow the first conduit 210 to communicate with the outside in the inner space of the housing body 100. The gas introduced from the outside may flow into the first conduit 210 through the first gas conduit 310.

Referring to FIG. 3, the first gas conduit 310 may extend from the inside of the housing 10 toward the outside along the first direction crossing the reference direction. For example, the first gas conduit 310 may extend along the first direction from one end communicating with the first conduit 210. The first gas conduit 310 may be provided in the inner space of the housing 10 adjacent to the second side surface 102 of the housing 10. The second gas conduit 320 may be provided in the inner space of the housing 10 adjacent to the second side surface 102 of the housing 10.

The first gas conduit 310 may be disposed adjacent to the second gas conduit 320. For example, the first gas conduit 310 and the second gas conduit 320 may be partitioned in the inner space of the housing body 100 by a partial area of the housing body 100.

The first gas conduit 310 and the second gas conduit 320 may be sequentially disposed along the reference direction. For example, in the second side surface 102, the first gas conduit 310 and the second gas conduit 320 may be sequentially disposed along the reference direction.

The second gas conduit 320 may include a passage that transfers gas introduced from the outside to the second conduit 220. For example, the second gas conduit 320 may pass through the second conduit 220 to allow the second conduit 220 to communicate with the outside in the inner space of the housing body 100. The gas introduced externally through the second gas conduit 320 may flow into the second conduit 220.

The second gas conduit 320 may include a (second-1)th gas conduit 321 and a (second-2)th gas conduit 322.

The (second-1)th gas conduit 321 may communicate with the outside. For example, one end of the (second-1)th gas conduit 321 may communicate with the outside, and the other end may communicate with the (second-1)th gas conduit 321.

The (second-1)th gas conduit 321 may extend in the first direction crossing the reference direction. For example, the (second-1)th gas conduit 321 may extend along the first direction from the inside of the housing 10 toward the second opening 312.

Referring to FIG. 4, the (second-1)th gas conduit may include a (second-1-1)th gas conduit 510 and a (second-1-2)th gas conduit 520.

The (second-1-1)th gas conduit 510 may communicate with the outside of the dual venturi and the (second-1-2)th gas conduit 520.

For example, a partial area of the (second-1-1)th gas conduit 510 may communicate with the outside through the second opening 312. In the other partial area opposite to the partial area, the (second-1-1)th gas conduit 510 may communicate with the (second-1-2)th gas conduit 520.

The (second-1-1)th gas conduit 510 may have a first inner diameter D1. The (second-1-1)th gas conduit 510 has been described as being provided in a shape of a pipe having an inner diameter and an outer diameter, but this is only an example and is not limited thereto. For example, the (second-1-1)th gas conduit 510 may be provided in a three-dimensional shape having a rectangular cross-section or a rectangular parallelepiped cross-section.

The (second-1-2)th gas conduit 520 may communicate with the (second-1-1)th gas conduit 510 and the (second-2)th gas conduit 322.

For example, the (second-1-2)th gas conduit 520 may be connected to the (second-1-1)th gas conduit 510 through the opening/closing hole 640.

For example, the (second-1-2)th gas conduit 520 may communicate with the (second-2)th gas conduit 322 in a partial area of the side of the (second-1-2)th gas conduit 520. For example, the (second-1-2)th gas conduit 520 may communicate with the (second-2)th gas conduit 322 through the third opening 533 of the first cam body 531, which will be described later. The third opening 533 may be disposed in a direction toward the reference direction from a side surface of the (second-1-2)th gas conduit 520, but the defined direction of the third opening 533 is not limited thereto.

A first cam body 531 may be disposed inside the (second-1-2)th gas conduit 520. For example, the first cam body 531 disposed inside the (second-1-2)th gas conduit 520 may be provided as a gas passage through which the gas flows from the (second-1-2)th gas conduit 520 to the (second-2)th gas conduit 322 through the third opening 533.

The first cam body 531 may include a contact surface 630 facing the (second-1-1)th gas conduit 510.

The contact surface 630 may be an outer surface of the first cam body 531 facing the (second-1-1)th gas conduit 510. For example, the contact surface 630 may be a surface facing the inner space of the (second-1-1)th gas conduit 510. The contact surface 630 may be disposed in a direction toward the second opening 312.

The contact surface 630 of the first cam body 531 may further include an opening/closing hole 640. The contact surface 630 may further include an opening/closing hole 640 having a second inner diameter D2 less than the first inner diameter D1 of the (second-1-1)th gas conduit 510.

The contact surface 630 may be disposed to provide a stepped portion. For example, referring to FIG. 5, when viewed in the reference direction, the contact area of the (second-1-2)th gas conduit 520 on which the contact surface 630 is disposed may include a protrusion 631 protruding toward the A axis.

The contact surface 630 may be disposed to provide a stepped portion by the protrusion 631.

The opening/closing hole 640 may be disposed to be surrounded by the protrusion 631.

The opening/closing hole 640 defined in the contact surface 630 may be disposed on a boundary area between an inner space of the (second-1-1)th gas conduit 510 and an inner space of the (second-1-2)th gas conduit 520.

The damper 410 may be disposed on the contact surface 630. For example, the damper 410 may be disposed on the contact surface 630 of the first cam body 531 inside the (second-1-1)th gas conduit 510. For example, the damper 410 may be disposed on an area on which the stepped portion of the contact surface 630 is disposed. For example, the damper 410 may be disposed on the protrusion 631 of the contact surface 630. As the damper 410 may be disposed on the protrusion 631 and then be hooked, and thus, the damper 410 may be blocked from moving to the (second-1-2)th gas conduit 520.

The flow of gas may be controlled inside the (second-1-1)th gas conduit 510 by the damper 410 disposed on the contact surface 630. For example, the damper 410 disposed inside the (second-1-1)th gas conduit 510 may move linearly in the inner space of the (second-1-1)th gas conduit 510 to block or open the flow of gas flowing through the (second-2)th gas conduit 322 and the second conduit 220.

The damper 410 may cover the opening/closing hole 640 defined in the contact surface 630. For example, the damper 410 may be in contact with the partial area of the contact surface 630 surrounding the opening/closing hole 640 to cover the opening/closing hole 640. For example, the damper 410 may be disposed on the protrusion 631, and thus, the damper 410 may cover the opening/closing hole 640.

The flow of gas may be controlled by allowing the damper 410 covering the opening/closing hole 640 to move in the direction toward or against the second opening 312 inside the (second-1-1)th gas conduit 510.

For example, when supplying an additional gas to the combustion device, the damper 410 may move by the driver 30 in the first direction or toward the second opening 312. As the damper 410 moves toward the opening 312, the spring 420 may be compressed in the first direction or the direction toward the second opening 312.

As the damper 410 moves by the driver 30, the limitation of delaying the gas supply due to the damper 410 sticked on the contact surface 630 may be prevented.

For example, when the supply of the additional gas to the combustion device is blocked, the flow of gas inside the (second-1)th gas conduit 321 may be blocked by the damper 410. For example, the opening/closing hole 640 is covered by the damper 410 to block the flow of gas flowing from the (second-1-1)th gas conduit 510 to the (second-1-2)th gas conduit 520. For example, referring to FIG. 5, the damper 410 may move in the second direction or in a direction away from the second opening 312 to cover the opening/closing hole 640 defined inside the (second-1)th gas conduit 321.

As the opening/closing hole 640 is covered by the damper 410, the flow of gas flowing from the (second-1-1)th gas conduit 510 of the (second-1)th gas conduit 321 to the (second-1-2)th gas conduit 520 of the (second-1)th gas conduit 321 may be blocked. The flow of gas flowing into the (second-1-2)th gas conduit 520 may be blocked to block the flow of gas flowing into the (second-2)th gas conduit 322.

When the damper 410 moves in the direction away from the second opening 312, the compressed spring 420 may transmit restoring force to the damper 410. As the restoring force is transmitted to the damper 410, the damper 410 may be in airtight contact with the contact surface 630. For example, the damper 410 that receives the restoring force from the compressed spring 420 may be in contact with the contact surface 630 more tightly than the damper in which the spring 420 is not provided.

The damper 410 may be in airtight contact with the contact surface 630 of the damper 410 by a pressure of the gas flowing through the (second-1-1)th gas conduit 510 of the (second-1)th gas conduit 321.

The damper 410 may be in airtight contact with the contact surface 630 by the spring 420 and the pressure of the gas, and thus, the gas flowing from the (second-1)th gas conduit 321 to the (second-2)th gas conduit 322 may be blocked efficiently. For example, the spring 420 and the gas may provide the additional force to the damper 410, and thus, the damper 410 may be in airtight contact with the contact surface 630.

Since the damper 410 is in airtight contact with the contact surface 630, the gas may be prevented from leaking from the (second-1-1)th gas conduit 510 to the (second-1-2)th gas conduit 520 even when the gas supply is cut off.

The gas may be prevented from leaking, and thus, an additional injection member for gas management may not be required. Since the additional injection member is not required, the types of components constituting the dual venturi may be simplified, and management of the dual venturi may be easy.

The (second-2)th gas conduit 322 may communicate with the (second-1)th gas conduit 321 and the second conduit 220. For example, one end of the (second-2)th gas conduit 322 may communicate with the (second-1)th gas conduit 321, and the other end may communicate with the second conduit 220.

The (second-2)th gas conduit 322 may extend from one end of the (second-1)th gas conduit 321 in a direction inclined in the reference direction with respect to the first direction to allow the second conduit 220 and the (second-1)th gas conduit 321 to communicate with each other.

A length of the (second-2)th gas conduit 322 may be less than that of the (second-1)th gas conduit 321. The (second-2)th gas conduit 322 may be provided in a straight line along the inclined direction, but is not limited thereto. For example, the (second-2)th gas conduit 322 may be partially curved along the inclined direction and may have a length less than that of the (second-1)th gas conduit 321.

The (second-2)th gas conduit 332 may communicate with the second conduit 220 in a partial area of the second conduit 220 adjacent to the blade assembly 440 disposed inside the second conduit 220. For example, the (second-2)th gas conduit 332 may communicate with the second conduit 220 on a partial area of the second conduit 220 adjacent to the wing part 422 in a state in which the second conduit 220 is opened.

A length of the gas passage through which the gas flows from the (second-1)th gas conduit 321 to the second conduit 220 may be reduced by the (second-2)th gas conduit 322 having a length less than that of the (second-1)th gas conduit 321. For example, as the (second-2)th gas conduit 322 has the length less than that of the (second-1)th gas conduit 321, the gas supplied to the (second-1)th gas conduit 321 may flow within a time shorter than that of the gas passing through the gas conduit that is curved or has a relatively long distance.

For example, as the (second-2)th gas conduit 322 is connected to a partial area of the second conduit 220 adjacent to the blade assembly 440, the gas may flow within a time shorter than that of the gas passing through the conduit in which on which the (second-2)th gas conduit 322 is connected to an area adjacent to an outlet of the second conduit 220.

The gas may be supplied within a relatively short time to prevent the gas supply from being delayed.

In addition, since the gas is quickly supplied through the (second-2)th gas conduit 322, the additional injection member for the gas and air management may not be required. The additional injection member may not be required, and thus, the components of the dual venturi may be simplified, and the management of the dual venturi may be easy.

Figure 6:
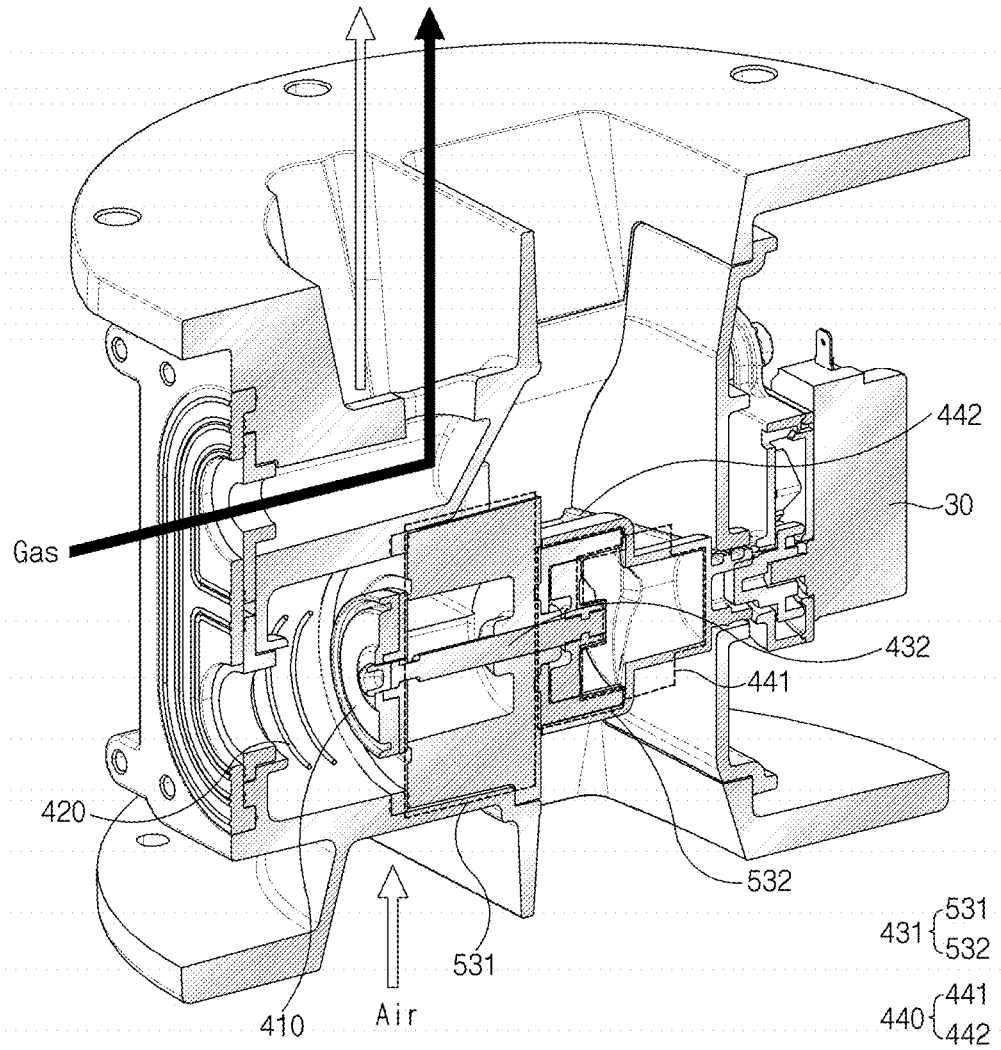
FIG. 6 is a perspective view illustrating the inside of the dual venturi of FIG. 1 in a state in which a second gas conduit and a second conduit are closed.

FIG. 6 is a perspective view illustrating the inside of the dual venturi of FIG. 1 in a state in which the second gas conduit and the second conduit are closed.

Figure 7:
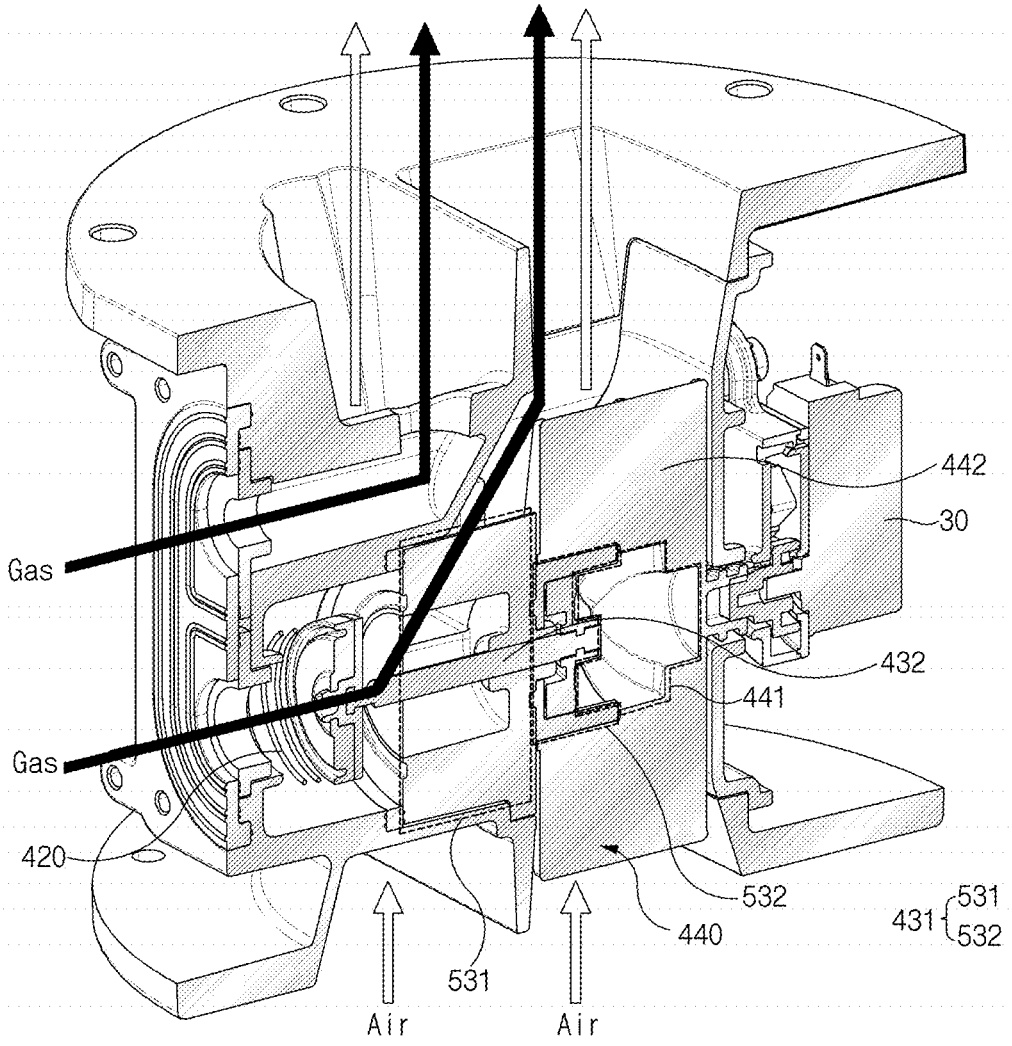
FIG. 7 is a perspective view illustrating the inside of the dual venturi of FIG. 1 in a state in which a second gas conduit and a second conduit are opened.

FIG. 7 is a perspective view illustrating the inside of the dual venturi of FIG. 1 in a state in which the second gas conduit and the second conduit are opened.

Referring to FIG. 6, the gas may flow through the first gas conduit 310 to the first conduit 210, and the air may flow through the first conduit 210.

As described above, the second gas conduit 320 may be closed by the damper 410 to block the flow of gas flowing through the second gas conduit 320. For example, the damper 410 may move along a longitudinal direction of the (second-1)th gas conduit 321 in the direction opposite to the second opening 312 to block the (second-1)th gas conduit 321.

As the second conduit 220 is closed by the blade assembly 440, the flow of air flowing through the second conduit 220 may be blocked. For example, the wing part 442 of the blade assembly 440 may rotate inside the second conduit 220 to seal the inner space of the second conduit 220, thereby blocking the flow of air flowing through the second conduit 220.

Referring to FIG. 7, as the second gas conduit 320 is opened by the movement of the damper 410, the flow of gas flowing through the second gas conduit 320 may be opened. For example, the damper 410 may move along the longitudinal direction of the (second-1)th gas conduit 321 toward the second opening 312 by the driver 30, and thus, the (second-1)th gas conduit 321 may be opened.

As described above, the damper 410 may move along the longitudinal direction of the (second-1)th gas conduit 321 by the driver 30 and the cam assembly 430.

As the damper 410 moves along the longitudinal direction of the (second-1)th gas conduit 321 by the driver 30, an opening time of the (second-1)th gas conduit 321 may decrease rather than that of the damper 410 driven by the spring.

The opening time of the (second-1)th gas conduit 321 among the second gas conduits 320 may be reduced to prevent the gas supply from being delayed. For example, even if the damper 410 is sticked within the second gas conduit 320, the damper 410 may move within the (second-1)th gas conduit 321 by the driving force of the driver 30. The (second-1)th gas conduit 321 may be quickly opened to prevent the gas supply from being delayed.

The gas supply may be prevented from being delayed, and thus, the additional injection member may not be required to adjust the gas supply. Since the additional injection member is not required, the types of components constituting the dual venturi may be simplified, and management of the dual venturi may be easy.

The gas supply may be prevented from being delayed, and thus, possibility of misfire of the combustion device including the dual venturi may be reduced.

The flow of air flowing inside the second conduit 220 may be controlled by the blade assembly 440.

For example, the second conduit 220 may be changed from the closed state to the opened state by the blade assembly 440. For example, in the state in which the second conduit 220 is closed, the wing part 442 of the blade assembly 440 may rotate within a range of about 1 degree to about 90 degrees by the driver 30 to open the second conduit 220.

As the second conduit 220 is opened, the flow of air flowing in the second conduit 220 may be opened. For example, the wing part 442 of the blade assembly 440 may be disposed along the reference direction, the inner space of the second conduit 220 may be opened to open the flow of air.

According to the present invention, the delay in supply of the gas may be prevented.

The above-disclosed subject matter is to be considered illustrative, and not restrictive, and the appended claims are intended to cover all such modifications, enhancements, and other embodiments, which fall within the true spirit and scope of the present invention. Thus, the embodiment of the present invention is to be considered illustrative, and not restrictive, and the technical spirit of the present invention is not limited to the foregoing embodiment. Therefore, the scope of the present invention is defined not by the detailed description of the invention but by the appended claims, and all differences within the scope will be construed as being included in the present invention.

What is claimed is:

1. A dual venturi comprising:

a housing comprising a housing body opened in a reference direction, an inner partition wall through which an inner space of the housing body is divided into a first conduit and a second conduit, and a gas providing part provided with a first gas conduit passing through the first conduit to allow the first conduit to communicate with the outside of the housing and a second gas conduit configured to allow the second conduit to communicate with the outside of the housing;

an opening/closing unit disposed in the inner space of the housing body to open and close the second gas conduit and the second conduit; and a driver connected to the opening/closing unit to provide driving force to the opening/closing unit, wherein the second gas conduit comprises:

a (second-1)th gas conduit configured to communicate with the outside of the housing and opened and closed by the opening/closing unit; and a (second-2)th gas conduit configured to allow the (second-1)th gas conduit to communicate with the second conduit, wherein the opening/closing unit comprises a damper configured to control a flow of gas flowing through the second gas conduit, wherein the damper moves in a longitudinal direction of the (second-1)th gas conduit inside the (second-1)th gas conduit by the driver to control the flow of gas, wherein one end of the second gas conduit comprises an opening that is exposed to the outside of the housing, the damper moves along the longitudinal direction of the (second-1)th toward the opening by the driver to open the (second-1)th gas conduit, and the damper moves in a direction opposite to the direction facing the opening to close the (second-1)th gas conduit.

2. The dual venturi of claim 1, wherein the (second-1)th gas conduit extends in a first direction crossing the reference direction, and the (second-2)th gas conduit extends from one end of the (second-1)th gas conduit along a direction that is inclined to the reference direction with respect to the first direction to allow the (second-1)th gas conduit to communicate with the second conduit.

3. The dual venturi of claim 2, wherein the first gas conduit extends in the first direction, and the first gas conduit and the second gas conduit are sequentially disposed along the reference direction.

4. The dual venturi of claim 1, wherein the opening/closing unit further comprises a spring disposed between the damper and the opening, when the damper moves toward the opening, the spring is compressed, and when the damper moves in a direction away from the opening, the compressed spring is configured to allow the damper to be in close contact with an opening/closing hole defined in the (second-1)th gas conduit by restoring force.

5. The dual venturi of claim 1, wherein the opening/closing unit further comprises a cam assembly configured to connect the damper to the driver, wherein the cam assembly comprises:

a cam body disposed inside the second gas conduit and the second conduit; and a cam guide passing through the cam body to connect the damper to the driver.

6. The dual venturi of claim 5, wherein the opening/closing unit further comprises a blade assembly coupled to the cam body, wherein the blade assembly rotates inside the second conduit to control a flow of air flowing in the second conduit.

7. A dual venturi comprising:

a housing comprising a housing body opened in a reference direction, an inner partition wall through which an inner space of the housing body is divided into a first conduit and a second conduit, and a gas providing part provided with a first gas conduit passing through the first conduit to allow the first conduit to communicate with the outside of the housing and a second gas conduit configured to allow the second conduit to communicate with the outside of the housing;

an opening/closing unit disposed in the inner space of the housing body to open and close the second gas conduit and the second conduit; and a driver connected to the opening/closing unit to provide driving force to the opening/closing unit, wherein the second gas conduit comprises:

a (second-1)th gas conduit configured to communicate with the outside of the housing and opened and closed by the opening/closing unit; and a (second-2)th gas conduit configured to allow the (second-1)th gas conduit to communicate with the second conduit, wherein the opening/closing unit comprises a damper configured to control a flow of gas flowing through the second gas conduit, wherein the damper moves in a longitudinal direction of the (second-1)th gas conduit inside the (second-1)th gas conduit by the driver to control the flow of gas, wherein one end of the second gas conduit comprises an opening that is exposed to the outside of the housing, the damper moves along the longitudinal direction of the (second-1)th toward the opening by the driver to open the (second-1)th gas conduit, and the damper moves in a direction opposite to the direction facing the opening to close the (second-1)th gas conduit, wherein the opening/closing unit further comprises a cam assembly configured to connect the damper to the driver, wherein the cam assembly comprises:

a cam body disposed inside the second gas conduit and the second conduit; and a cam guide passing through the cam body to connect the damper to the driver, wherein the opening/closing unit further comprises a blade assembly coupled to the cam body, wherein the blade assembly rotates inside the second conduit to control a flow of air flowing in the second conduit, wherein the blade assembly comprises:

a blade body connected to the driver and disposed inside the second conduit; and a wing part disposed on an outer surface of the blade body to open and close the second conduit, the cam body comprises:

a first cam body disposed inside the second gas conduit; and a second cam body connected to the first cam body and being in contact with the blade assembly of the opening/closing unit, the second cam body moves in the direction facing the opening or an opposite direction by allowing the blade body to rotate by the driver so that convex portions of each of the second cam body and the blade body are in contact with each other to correspond to each other or are engaged with each other, and the cam guide connected to the second cam body passes through the first cam body to allow the damper to move in the direction facing the opening or the opposite direction.

8. The dual venturi of claim 7, wherein the (second-1)th gas conduit comprises:

a (second-1-1)th gas conduit having one end communicating with the outside of the housing and including the opening; and a (second-1-2)th gas conduit having a portion communicating with the other end of the (second-1-1)th gas conduit and the other portion communicating with the (second-2)th gas conduit, wherein the damper is disposed inside the (second-1-1)th gas conduit to cover a portion of a contact surface of the first cam body disposed inside the (second-1-2)th gas conduit.

9. The dual venturi of claim 8, wherein an opening/closing hole through which the inside of the (second-1-1)th gas conduit and the inside of the (second-1-2)th gas conduit are connected to each other is defined in the portion of the contact surface, and the damper is configured to cover the opening/closing hole so as to block a flow of gas flowing through the (second-1-2)th gas conduit in the (second-1-1)th gas conduit.

10. A dual venturi comprising:

a housing comprising a housing body opened in a reference direction, an inner partition wall through which an inner space of the housing body is divided into a first conduit and a second conduit, and a gas providing part provided with a first gas conduit passing through the first conduit to allow the first conduit to communicate with the outside of the housing and a second gas conduit configured to allow the second conduit to communicate with the outside of the housing;

an opening/closing unit disposed in the inner space of the housing body to open and close the second gas conduit and the second conduit; and a driver connected to the opening/closing unit the through a cam assembly to provide driving force to the opening/closing unit, wherein the second gas conduit comprises:

a (second-1)th gas conduit configured to communicate with the outside of the housing and opened and closed by the opening/closing unit; and a (second-2)th gas conduit configured to allow the (second-1)th gas conduit to communicate with the second conduit, the second gas conduit is configured to communicate with one region of the second conduit adjacent to the cam assembly, and wherein the opening/closing unit comprises a damper configured to control a flow of gas flowing through the second gas conduit, wherein the damper moves in a longitudinal direction of the (second-1)th gas conduit inside the (second-1)th gas conduit by the driver to control a flow of gas introduced from the outside of the housing to the (second-1)th gas conduit, wherein one end of the second gas conduit comprises an opening that is exposed to the outside of the housing, the damper moves along the longitudinal direction of the (second-1)th toward the opening by the driver to open the (second-1)th gas conduit, and the damper moves in a direction opposite to the direction facing the opening to close the (second-1)th gas conduit.

11. The dual venturi of claim 10, wherein the opening/closing unit comprises:

a blade assembly rotating inside the second conduit, wherein the blade assembly is configured to control a flow of air flowing through the second conduit.

12. The dual venturi of claim 11, wherein the opening/closing unit further comprises a spring disposed between an opening of the (second-1)th gas conduit and the damper, wherein the spring is configured to transmit restoring force to the damper so as to control the flow of gas into the (second-1)th gas conduit.

* * * * *